US010400763B2

(12) United States Patent
De Andrade et al.

(10) Patent No.: US 10,400,763 B2
(45) Date of Patent: Sep. 3, 2019

(54) HEAD FASTENING ARRANGEMENT OF COOLING COMPRESSOR

(71) Applicant: Whirlpool S.A., Sao Paulo (BR)

(72) Inventors: Daniel Lacerda De Andrade, Joinville (BR); Diego Sacomori, Joinville (BR); Mattias da Silva Castro, Joinville (BR); Alexandre de Assis Pereira, Joinville (BR)

(73) Assignee: Embraco-Industria De Compressores E Solucoes EM Refrigeracao LtdA., Joinville (BR)

( * ) Notice: Subject to any disclaimer, the term of this patent is extended or adjusted under 35 U.S.C. 154(b) by 188 days.

(21) Appl. No.: 15/618,249

(22) Filed: Jun. 9, 2017

(65) Prior Publication Data

US 2017/0356437 A1 Dec. 14, 2017

(30) Foreign Application Priority Data

Jun. 14, 2016 (BR) ..... 10 2016 013780

(51) Int. Cl.

| | |
|---|---|
| ***F04B 53/00*** | (2006.01) |
| ***F15B 15/14*** | (2006.01) |
| ***F04B 53/14*** | (2006.01) |
| ***F04B 53/16*** | (2006.01) |
| ***F04B 39/12*** | (2006.01) |
| ***F04B 39/14*** | (2006.01) |

(52) U.S. Cl.

CPC ..... *F04B 53/007* (2013.01); *F04B 39/12* (2013.01); *F04B 39/125* (2013.01); *F04B 39/14* (2013.01); *F04B 53/14* (2013.01); *F04B 53/162* (2013.01); *F15B 15/1438* (2013.01)

(58) Field of Classification Search

CPC ..... F15B 15/1433; F15B 15/1438; F04B 39/125; F04B 39/14; F04B 53/007; F04B 53/162

See application file for complete search history.

(56) References Cited

U.S. PATENT DOCUMENTS

| | | | | |
|---|---|---|---|---|
| 2,148,639 A * | 2/1939 | Pielstick | ..... | F02F 7/0012 92/149 |
| 9,074,591 B2 | 7/2015 | Kita | | |
| 2014/0020554 A1* | 1/2014 | Wang | ..... | F04B 39/121 92/169.1 |

FOREIGN PATENT DOCUMENTS

KR 20010054069 A 7/2001

* cited by examiner

*Primary Examiner* — Michael Leslie
(74) *Attorney, Agent, or Firm* — Harrington & Smith

(57) ABSTRACT

The present invention belongs to the technological field of the head fastening and its components to the block of a compressor, such as those used in cooling systems of household appliances. The head fastening arrangement of cooling compressor includes a head arranged by the cylinder of the cooling compressor and having a head lid; at least one supporting device also arranged by the cylinder; at least one element of union of the head lid to the supporting device, wherein the element of union is capable of transmitting force that presses the head lid and the supporting device against the cylinder.

20 Claims, 7 Drawing Sheets

HEAD FASTENING ARRANGEMENT OF COOLING COMPRESSOR

FIELD OF THE INVENTION

The present invention refers to a new constructive arrangement for fastening the head to the block (and, more precisely, to the cylinder) of a cooling compressor. The object of the present invention discloses a solution developed to increase the fastening efficiency of the head and reduce the manufacturing costs of the components.

BACKGROUND OF THE INVENTION

The fastening of the head to the compressor block and, more precisely, to the cylinder, faces some challenges inherent to the functioning of the compressor. Among these challenges to be overcome are the sealing of the gaskets between the cylinder and the parts that compose the head and also the deformation of the cylinder wall resulting from the transfer of the fastening forces of the head.

Nowadays, the conventional way for fastening the head to the cylinder involves making indexing holes, by which normally four screws pass through that align the set present on the head (valve, valve plates and the head lid) to the holes located around the wall of the cylinder block. An example of this conventional way is illustrated in FIG. 9.

This conventional way presents some drawbacks. Firstly, it is necessary to apply high fastening forces over the screws so that it is possible to guarantee the gaskets sealing, since the contact pressure is more concentrated at the region around the screws, where there is no need to be sealed. These high fastening forces end up generating deformations that are transferred to the cylinder wall. Secondly, there must be holes in all the head components, and mainly threaded holes at the cylinder block, wherein such holes require high precision of position tolerances and high machining time, which, without doubt, significantly raises the cost of such solution.

In relation to the patent documents, the above mentioned way of fastening using screws can be found, for example, in the document U.S. Pat. No. 9,074,591.

Another example can be checked on the document KR 2001054069. Such document describes a solution that uses a clamp to assist the fastening and alignment between the discharge valve, valve plate and suction valve. The clamp is arranged at the front of the head. However, the clamp has only the function of auxiliary the alignment and the fastening, so that the fastening and alignment themselves are still in charge of the same screws mentioned in the conventional solution previously described.

As noted, the state of the art still lacks a head fastening solution for refrigeration compressors that presents low manufacturing complexity and low cost, without further resulting in a decrease of the efficiency of fastening and collateral damage, such as, for example, the increase of deformations on the cylinder wall of the block.

OBJECTIVES OF THE INVENTION

Therefore, the present invention basically aims to solve the problem of high complexity of the head fastening solutions and consequently, of the high manufacturing costs, for the current existing refrigeration compressors.

It is also one of the objectives of the present invention to minimize the deformations arising from the transfer of the head fastening forces to the cylinder wall by a fastening arrangement, which ensures the sealing between the head and cylinder gaskets.

BRIEF DESCRIPTION OF THE INVENTION

The objectives of the present invention are achieved by means of a head fastening arrangement of cooling compressor comprising: a head arranged by the cylinder of the hermetic compressor having a lid; at least one supporting device also arranged by the cylinder; and at least one element of union of the head lid to the supporting device, being the element of union capable of transmitting force that presses the head lid and the supporting device against the cylinder.

BRIEF DESCRIPTION OF THE DRAWINGS

The present invention will be described in detail on the basis of the following figures, in which:

FIG. 8 shows top outlined sectional view, in which it is illustrated, in a purposely exaggerated manner, the deformations to which the supporting device shown in FIG. 2 is subjected to.

DETAILED DESCRIPTION OF THE INVENTION

Figure 1:
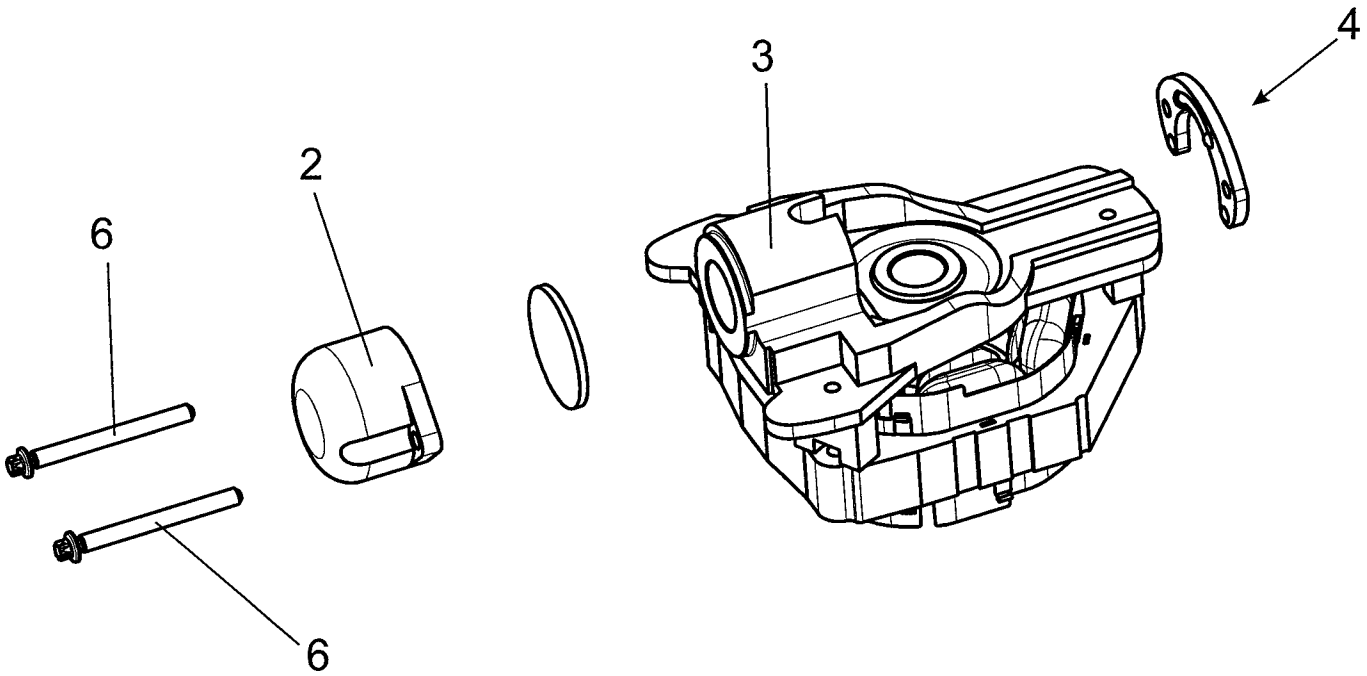
FIG. 1 is an exploded perspective view of the head fastening arrangement of the present invention; it is a perspective view of an inner part of a hermetic compressor and, more precisely, its superior part where the head, cylinder, piston, connecting rod, among other components known by a person skilled in the art are located.

The object of the present invention will be further described in detail and explained on the basis of the attached drawings, which merely present illustrative and non-limiting character, since adjustments and modifications can be made without, with this, evading the scope of the claimed protection.

The fastening arrangement of the present invention is preferably applied in refrigeration compressors, such as, for example, those used in household and commercial refrigeration systems. Evidently, the present invention does not restrict itself to such application; it is only one of the possibilities that fall within the scope of the claims.

As it is noted from FIGS. 1, 3, 4 and 5, the fastening arrangement of the present invention comprises a head arranged by the cylinder 3 of the compressor. The head presents a lid 2. By the way, the lid 2, which is also known as "cylinder lid" here will be called head lid 2, since it encompasses the head components. However, in any way this small nomenclature difference cannot be seen as diminishing or harming the understanding of the scope of protection of the present invention.

Furthermore, the fastening arrangement 1 of the present invention also comprises at least one supporting device 4 also arranged by the cylinder 3. In an embodiment of the present invention, the supporting device 4 is arranged in an opposite position in relation to the head and, consequently, to the head lid 2. Moreover, within the scope of the present invention, the arrangement 1 can be accomplished with more than one supporting device 4. In the exemplified embodiment of the invention illustrated in FIGS. 1, 3, 4 and 5, the supporting device 4 is arranged by the rear 14 of the cylinder 3 and the head is arranged by the front of the cylinder 3. In other configurations of the present invention, the said supporting device 4 can be arranged by the intermediate region of the cylinder 3. Obviously, the "front" and "rear" terms herein have the character of assigning a minimal spatial reference to the reader and, thus, should not be taken to a strictly literal interpretation.

Figure 2:
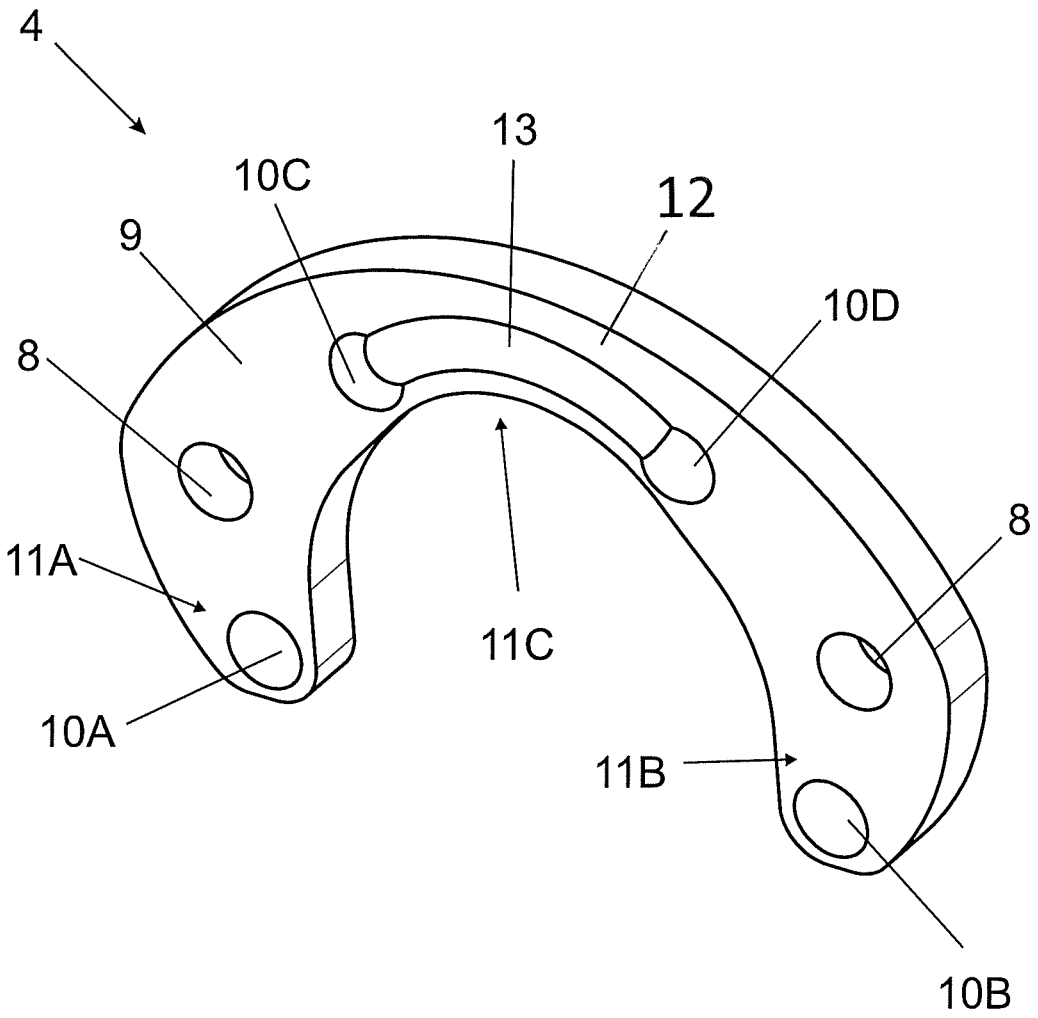
FIG. 2 is a perspective view of the supporting apparatus of the present invention.
Figure 3:
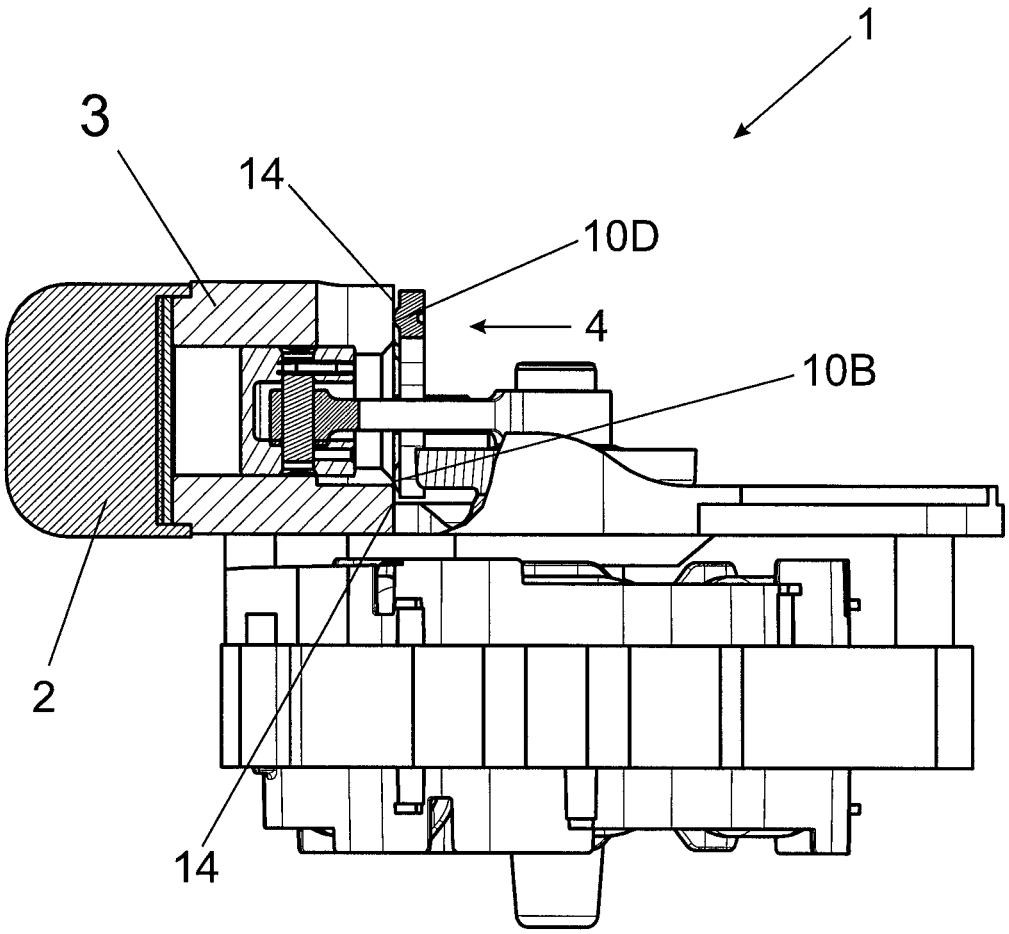
FIG. 3 is a side cross-sectional view of the cylinder of a hermetic compressor comprising the apparatus of the present invention.
Figure 4:
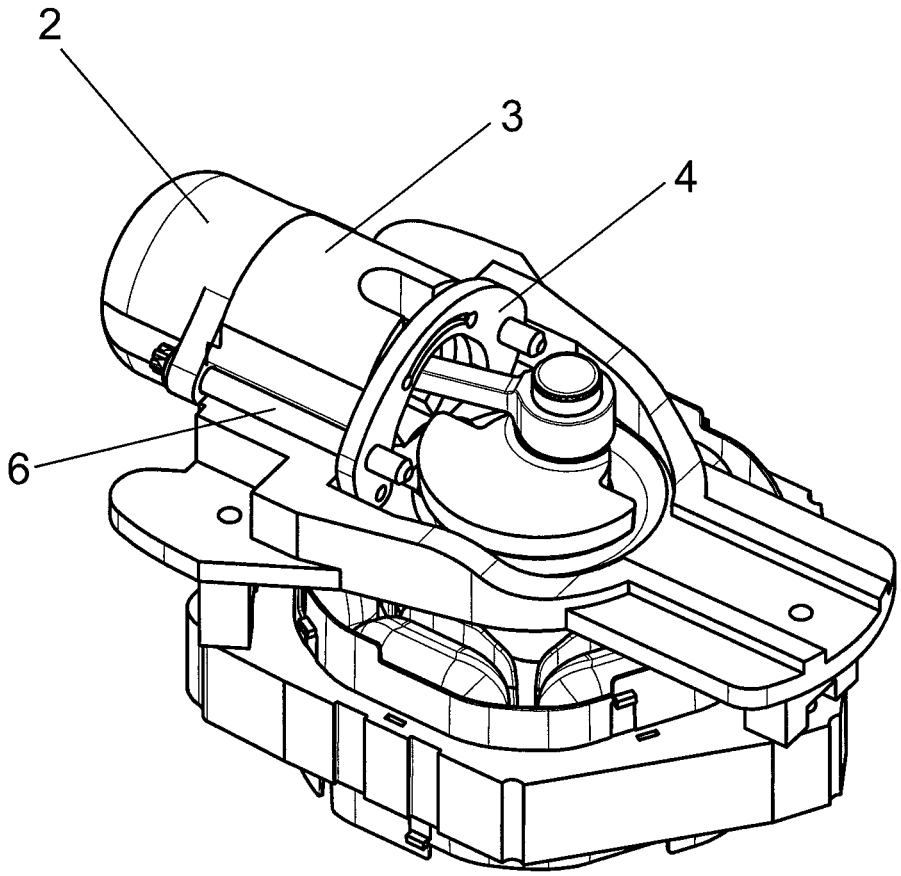
FIG. 4 is a perspective view of the apparatus of the present invention.
Figure 5:
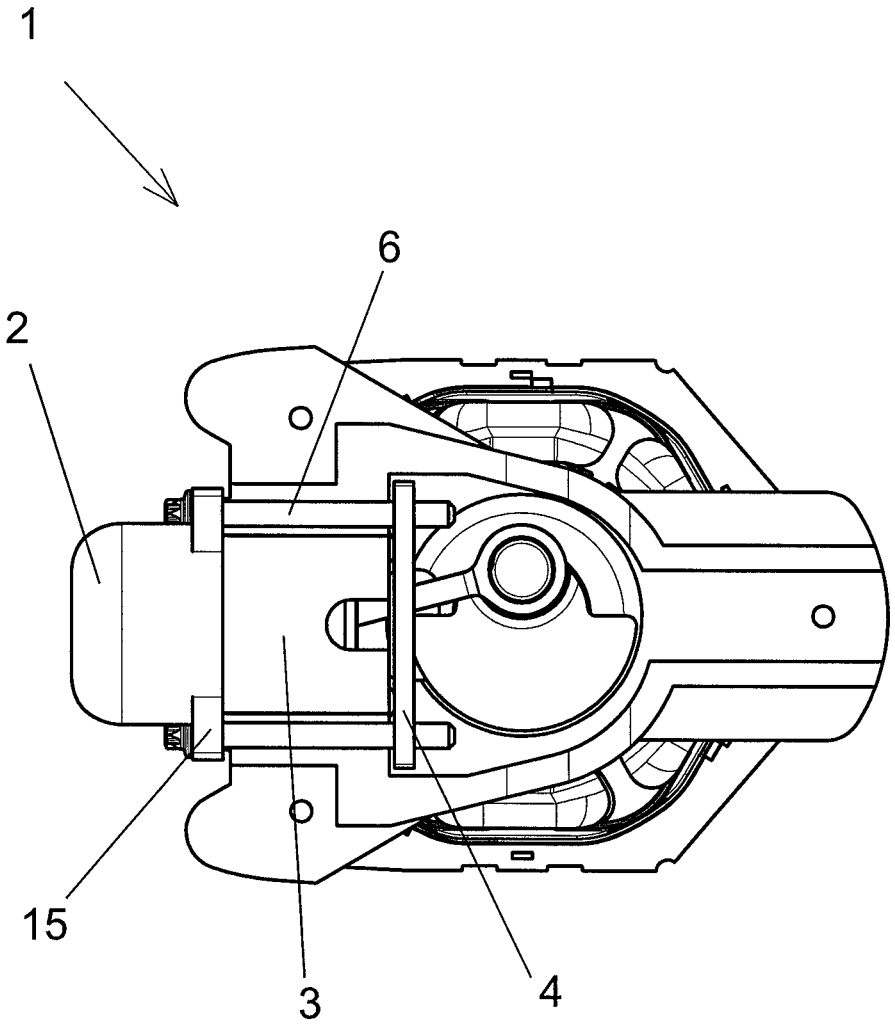
FIG. 5 is a superior view of the apparatus of the present invention.

Making now reference to the FIG. 2, it is possible to see that the supporting device 4 comprises a substantially arched format or, in other words, a "horseshoe" format. This particular arched format counts with two end zones 11A and 11B and a retreated zone 11C arranged between the end zones 11A and 11B. Furthermore, the supporting device 4 comprises spare contract regions 10A, 10B, 10C and 10D arranged on its surface 9 facing the cylinder 3. More precisely, the supporting device 4 comprises four spare contact regions, 10B, 10C and 10D, wherein a first 10A and a second 10B spare contact regions are arranged, respectively, at a first end zone 11A and at a second end zone 11B of the arched body of the supporting device 4. Moreover, a third and fourth spare contact regions 10C and 10D are arranged at the retreated zone 12 of the arched body of the supporting device 4.

In addition to the contact regions 10C and 10D, the retreated zone 12 additionally comprises a rigidity segment 13, which is also spared in relation to the surface 9. Wherein the function of such segment 13 is precisely to implement the rigidity of the supporting device 4, as its own name already says. In the example of the embodiment of the invention illustrated in the figures, such segment 13 comprises an arc format and is arranged between the third and fourth contact regions 10C and 10D, being connected to both.

Additionally, it is worth to highlight herein that the spare contact regions 10A, 10B, 10C and 10D can present any format within the scope of the invention. Thus, for example, in the figures, these contact regions 10A, 10B, 10C and 10D are illustrated as substantially circular rebounds, however, other forms can be adopted, since the figures represent only one of the various possibilities for implementing the invention.

The fastening arrangement 1 of the present invention additionally comprises at least one element of union 6 of the head lid 2 to at least one supporting device 4, being the element of union 6 capable of transmitting force that presses the head lid 2 and the supporting device 4 against the cylinder 3. In an embodiment of the present invention, the element of union 6 is a screw associated with at least one thread arranged on the supporting device 4. In other embodiments of the invention, the element of union 6 may be another piece, arrangement or mechanism that exerts the function of pressing the supporting device 4 and the head lid 2 against the cylinder 3 and may also be or not be associated with a nut or thread. By the way, the term "thread" mentioned herein also covers equivalent parts, such as nut or any other one that can be used by a screw to perform the functions described herein.

In the embodiment of the invention the element of union 6 is a screw associated with at least one thread provided in the supporting device 4, wherein the head lid 2 has at least one perforated projecting tab 15. This perforated projecting tab 15 extends beyond the diameter of the cylinder, as it can be noted from FIGS. 1, 4 and 5. Particularly, the head lid 2 comprises at least two projecting tabs 15 and, even more particularly, the lid 2 comprises two projecting tabs 15, located in opposite positions in relation to each other.

On the other hand, the supporting device 4 is endowed with at least one fastening hole 8, wherein in the embodiment illustrated in FIG. 2, the supporting device 4 comprises two fastening holes 8 located in opposite positions to each other. From this construction, perforated projecting tabs 15 and the fastening holes 8 are aligned to each other, so that the screw is configured to traverse the fastening hole 8 and the drilling of said projecting tab 15. In this way, the supporting device 4 and the lid 2 are united, so as to have transmission of a force that will press them against the cylinder 3, as already said, and consequently, also pressing them against each other. As for fastening of the screw in this embodiment of the invention, one or more threads can be provided by the fastening hole 8 of the supporting device 4.

Figure 8:
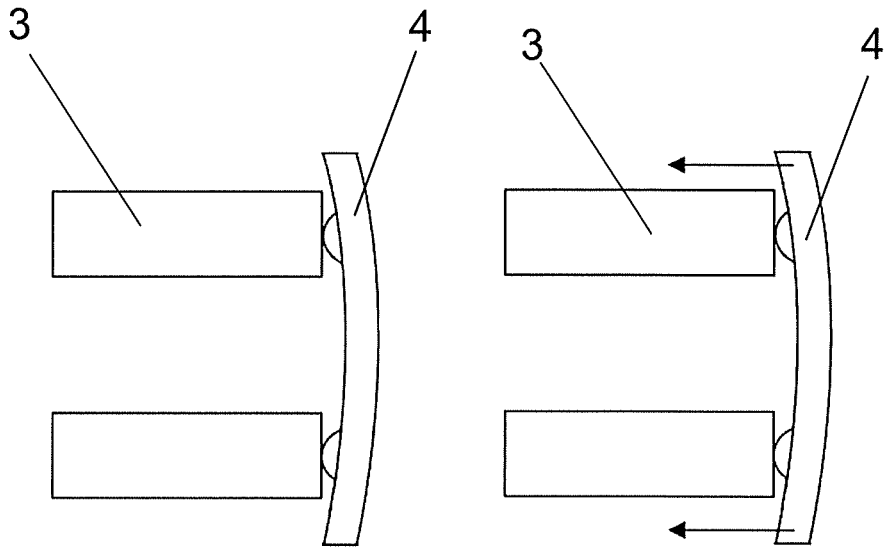
Figure 9:
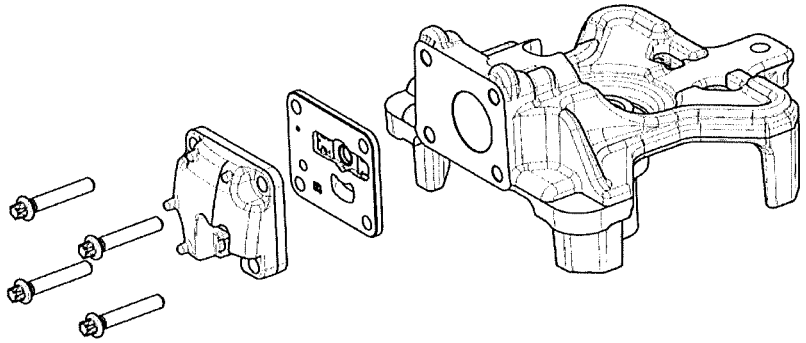
FIG. 9 PRIOR ART
FIG. 9 illustrates the conventional solution of the state of the art.

From the above described construction of the fastening arrangement 1 of the present invention, it is possible to fasten the head to the compressor block more efficiently, using fewer components, and without diminishing the quality of the fastening. In addition to these advantages, it is worth mentioning the spare contact regions 10A, 10B, 10C and 10D, which make the present invention even better. These regions are those that effectively touch the cylinder 3 on its rear 14, as it can be seen in FIG. 3. Thus, when concentrating the physical contact with the cylinder 3 at the spare contract regions 10A, 10B, 10C and 10D, it is transmitted the fastening force in cooperation with the element of union 6 (and its possible additional components, such as threads, for example) only at specific points, which significantly decreases the transfer of moments to the cylinder. If these spare contact regions 10A, 10B, 10C and 10D were not used, all or great part of the surface 9 would be in contact with the cylinder 3, which would greatly increase the transferred moments. The effect of the contact regions 10A, 10B, 10C and 10D can be checked in FIG. 8, which schematically shows the action of moments.

Figure 6:
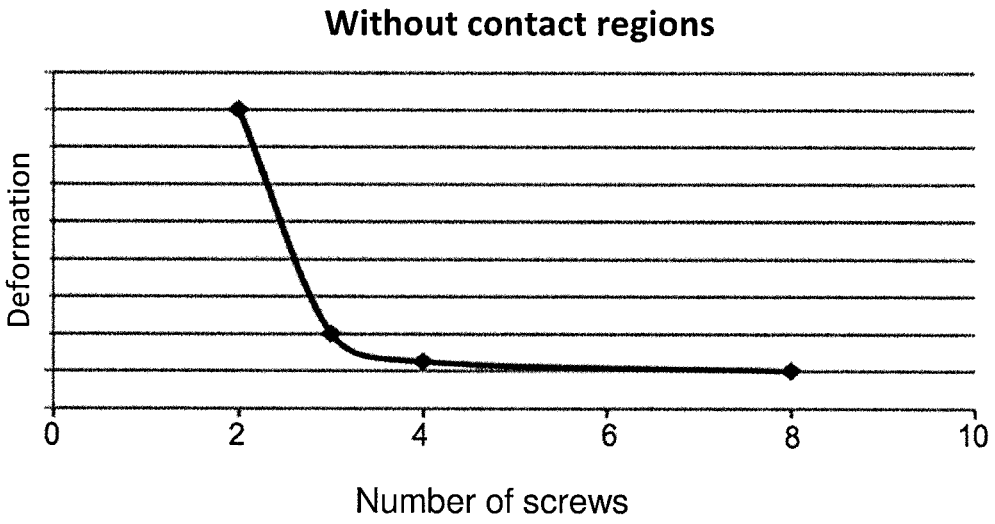
FIG. 6 shows a graph of the deformation as a function of the number of screws in the conventional fastening solution.

Consequently, when implementing the contact regions 10A, 10B, 10C and 10D, a safe and effective fixation is guaranteed, enabling to reduce the number of components intended for fastening. In this sense, it is worth mentioning again the FIG. 6. Such figure, in addition to demonstrating how much the deformation varies depending on the number of screws in the conventional solution of the state of the art, it also shows what occurs in cases where the supporting device 4 is employed without the spare contact regions 10A, 10B, 10C and 10D. In this scenario, in order to achieve an efficient and low-deformation fastening, a large number of screws should be employed. It is important to remember that increasing the number of screws does not only involve the cost of each one of them, but it also involves performing precise holes to the components in which it will pass through.

Figure 7:
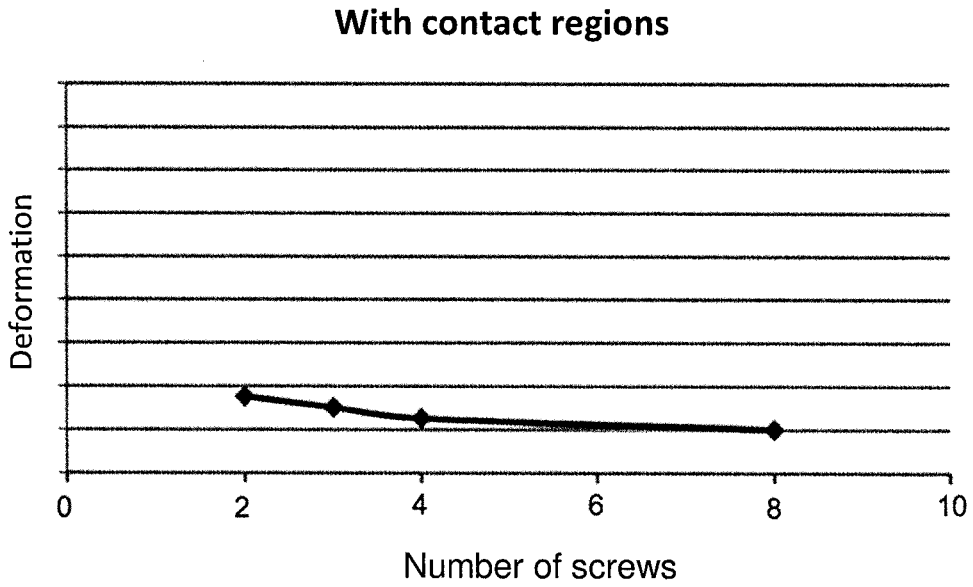
FIG. 7 shows a graph of the deformation as a function of the number of screws according to the apparatus of the present invention.

On the other hand, from the fastening arrangement 1 of the present invention, it is possible not only to achieve adequate fastening, but also decrease costs in function of the significant reduction of the block machining areas and the contour perimeter of the head components, in addition to the possibility of reducing the number of screws maintaining the deformation of the cylinder wall at appropriate levels. This behavior is illustrated in FIG. 7.

As noted, the present invention fully solves the problems of the state of the art, providing a more efficient fastening solution and allowing the number of components to be decreased.

The invention claimed is:

1. Head fastening arrangement of cooling compressor comprising:

a head arranged by a cylinder of the cooling compressor and having a head lid, at least one supporting device also arranged by the cylinder;

at least one element of union of the head lid to the supporting device, wherein the element of union is capable of transmitting force that presses the head lid and the supporting device against the cylinder;

characterized by the fact that:

the head is arranged at a front of the cylinder and the supporting device is arranged at a rear part of the cylinder;

wherein the at least one supporting device is arranged at an opposite position to the head and comprises spare contact regions arranged on a surface of the at least one supporting device faced to the cylinder.

2. Arrangement, according to claim 1, characterized by the fact that the supporting device comprises at least four spare contact regions.

3. Arrangement, according to claim 2, characterized by the fact that the supporting device comprises an arched body, and that a first and a second spared contact region are arranged, respectively, in a first end zone and in a second end zone of the arched body of the supporting device, further wherein a third and fourth contact regions are arranged in a retreated area of the arched body of the supporting device.

4. Arrangement according to claim 3, characterized by the fact that in the retreated area of the arched body of the supporting device the retreated area is also provided with a rigidity segment, which comprises an arc format and is arranged between the third and fourth contact regions, being connected to both.

5. Arrangement, according to claim 1, characterized by the fact that the supporting device comprises an arched body.

6. Arrangement, according to claim 1, characterized by the fact that the element of union is a screw associated with at least one thread, wherein the head lid is endowed with at least one perforated projecting tab and the supporting device is endowed with at least one fastening hole, further wherein the screw is configured to traverse the said fastening hole and the perforation of the said at least one perforated projecting tab.

7. Arrangement, according to claim 6, characterized by the fact that the element of union comprises two screws, each one associated with at least one thread provided by the fastening hole of the supporting device.

8. Arrangement, according to claim 6, characterized by the fact that the supporting device comprises at least two fastening holes located in opposite positions to each other; the head lid comprises at least two perforated projecting tabs located in opposite positions to each other; being the perforated projecting tabs and the fastening holes aligned one in relation to other.

9. A head fastening arrangement of a cooling compressor, comprising:

a head arranged by a cylinder of the cooling compressor and having a head lid, at least one supporting device also arranged by the cylinder; and at least one element of union of the head lid to the supporting device, wherein the element of union is capable of transmitting force that presses the head lid and the supporting device against the cylinder;

wherein the at least one supporting device is arranged at an opposite position to the head and comprises spare contact regions arranged on a surface of the at least one supporting device faced to the cylinder; and wherein the supporting device comprises at least four spare contact regions.

10. The head fastening arrangement of a cooling compressor of claim 9, wherein the supporting device comprises an arched body; and wherein a first and a second spared contact region are arranged, respectively, in a first end zone and in a second end zone of the arched body of the supporting device, further wherein third and fourth contact regions are arranged in a retreated area of the arched body of the supporting device.

11. The head fastening arrangement of a cooling compressor of claim 10, wherein in the retreated area of the arched body of the supporting device the retreated area is also provided with a rigidity segment, which comprises an arc format and is arranged between the third and fourth contact regions, being connected to both the third and fourth contact regions.

12. The head fastening arrangement of a cooling compressor of claim 9, wherein the head is arranged at a front of the cylinder and the supporting device is arranged at a rear part of the cylinder.

13. The head fastening arrangement of a cooling compressor of claim 9, wherein the element of union is a screw associated with at least one thread, wherein the head lid is endowed with at least one perforated projecting tab and the supporting device is endowed with at least one fastening hole, further wherein the screw is configured to traverse the said fastening hole and the perforation of the at least one projecting tab.

14. The head fastening arrangement of a cooling compressor of claim 13, wherein the element of union comprises two screws, each one associated with at least one thread provided by the fastening hole of the supporting device.

15. A head fastening arrangement of a cooling compressor, comprising:

a head arranged by a cylinder of the cooling compressor and having a head lid, at least one supporting device also arranged by the cylinder; and at least one element of union of the head lid to the supporting device, wherein the element of union is capable of transmitting force that presses the head lid and the supporting device against the cylinder;

wherein the at least one supporting device is arranged at an opposite position to the head and comprises spare contact regions arranged on a surface of the at least one supporting device faced to the cylinder; and wherein the supporting device comprises at least four spare contact regions;

wherein the supporting device comprises an arched body; and wherein a first and a second spared contact region are arranged, respectively, in a first end zone and in a second end zone of the arched body of the supporting device, further wherein third and fourth contact regions are arranged in a retreated area of the arched body of the supporting device.

16. The head fastening arrangement of a cooling compressor of claim 15, wherein in the retreated area of the arched body of the supporting device the retreated area is also provided with a rigidity segment, which comprises an arc format and is arranged between the third and fourth contact regions, being connected to both the third and fourth contact regions.

17. The head fastening arrangement of a cooling compressor of claim 15, wherein the head is arranged at a front of the cylinder and the supporting device is arranged at a rear part of the cylinder.

18. The head fastening arrangement of a cooling compressor of claim 15, wherein the element of union is a screw associated with at least one thread, wherein the head lid is endowed with at least one perforated projecting tab and the supporting device is endowed with at least one fastening hole, further wherein the screw is configured to traverse the said fastening hole and the perforation of the at least one projecting tab.

19. The head fastening arrangement of a cooling compressor of claim 18, wherein the element of union comprises two screws, each one associated with at least one thread provided by the fastening hole of the supporting device.

20. The head fastening arrangement of a cooling compressor of claim 18, wherein the supporting device comprises at least two fastening holes located in opposite positions to each other; the head lid comprises at least two perforated projecting tabs located in opposite positions to each other; being the perforated projecting tabs and the fastening holes aligned one in relation to other.

* * * * *